US005839821A

United States Patent [19]

LeZotte

[11] Patent Number: 5,839,821

[45] Date of Patent: Nov. 24, 1998

[54] FLASHLIGHT WITH FORWARD LOOKING SENSING OF THERMAL BODIES

[76] Inventor: Bruce A. LeZotte, 266 Santa Margarita St., Menlo Park, Calif. 94025

[21] Appl. No.: 772,381

[22] Filed: Dec. 23, 1996

[51] Int. Cl.[6] ..... F21V 33/00

[52] U.S. Cl. ..... 362/253; 362/109; 362/208; 340/567; 340/573

[58] Field of Search ..... 362/86, 109, 208, 362/234, 253, 276, 802; 340/555, 556, 565, 567, 573, 586, 600

[56] References Cited

U.S. PATENT DOCUMENTS

| | | | |
|---|---|---|---|
| D. 296,531 | 7/1988 | Kotlicki et al. | D10/106 |
| D. 339,759 | 9/1993 | Ho | D10/106 |
| D. 364,827 | 12/1995 | Carmi | D10/106 |
| 4,045,663 | 8/1977 | Young | 362/253 |
| 4,634,294 | 1/1987 | Christol et al. | 340/600 |
| 4,697,081 | 9/1987 | Baker | 250/338 |
| 4,717,910 | 1/1988 | Scripps et al. | 340/586 |
| 4,734,858 | 3/1988 | Owers | 250/353 |
| 4,949,077 | 8/1990 | Mbuthia | 362/253 |
| 5,040,099 | 8/1991 | Harris | 362/802 |
| 5,172,031 | 12/1992 | Matsui et al. | 315/129 |
| 5,260,858 | 11/1993 | Maglica | 362/205 |
| 5,309,145 | 5/1994 | Branch et al. | 362/253 |
| 5,382,799 | 1/1995 | May | 250/372 |
| 5,400,232 | 3/1995 | Wong | 362/276 |
| 5,410,237 | 4/1995 | Sharrah et al. | 320/2 |
| 5,420,428 | 5/1995 | Bullington et al. | 250/338.2 |
| 5,432,689 | 7/1995 | Sharrah et al. | 362/183 |
| 5,436,614 | 7/1995 | Torikoshi et al. | 340/584 |
| 5,438,322 | 8/1995 | Martin et al. | 340/584 |
| 5,463,595 | 10/1995 | Rodhall et al. | 340/573 |
| 5,479,025 | 12/1995 | Honiu et al. | 250/504 R |
| 5,489,891 | 2/1996 | Diong et al. | 362/802 |
| 5,627,518 | 5/1997 | Wishart | 340/567 |

*Primary Examiner*—Alan Cariaso
*Attorney, Agent, or Firm*—Burns, Doane, Swecker & Mathis, LLP

[57] ABSTRACT

A flashlight includes a light source and a detector for detecting emissions from the surroundings. Depending on the position of a switch, the output of the detector is channeled through either a speaker or a LED array. The speaker outputs a tone having a frequency dependent on the intensity of the electromagnetic emissions. The LED array illuminates a series of LED elements in a manner representative of the intensity of the electromagnetic emissions. In one embodiment, the flashlight incorporates infrared detectors for detecting infrared thermal emissions.

22 Claims, 2 Drawing Sheets

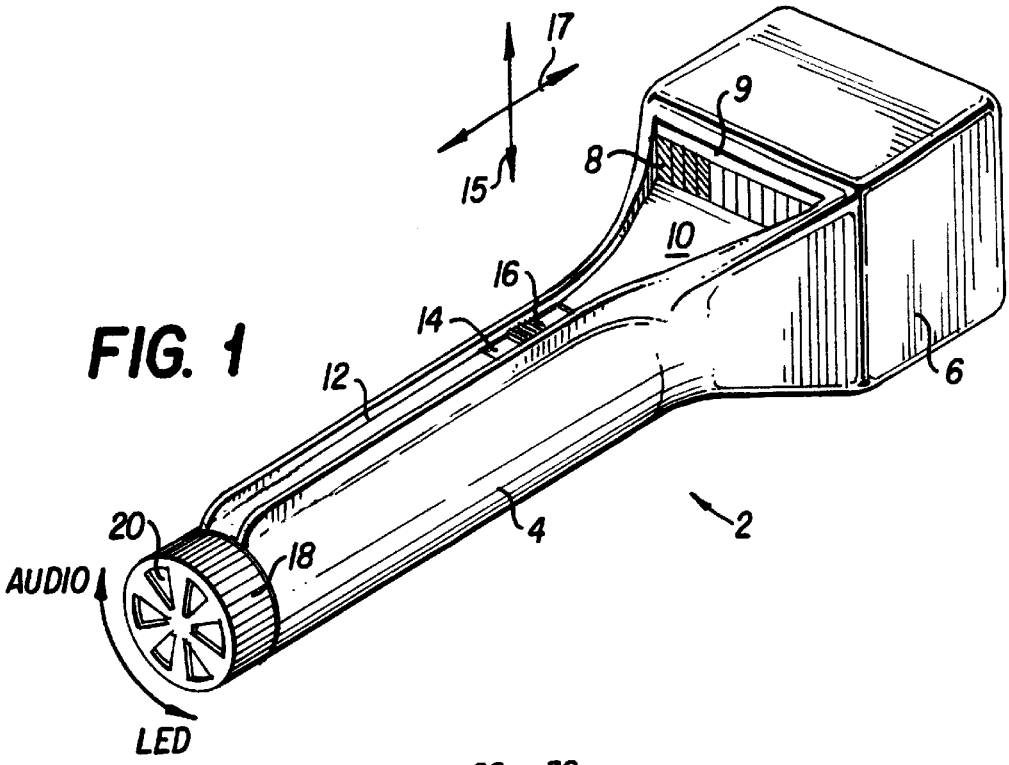
FIG. 1
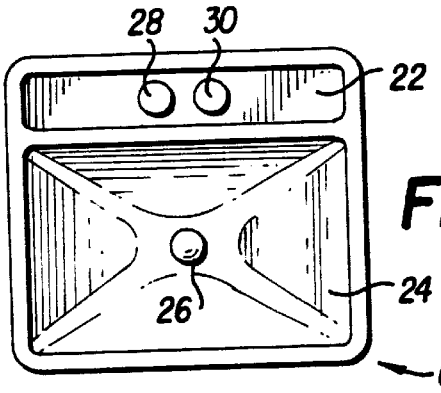
FIG. 2
FIG. 3
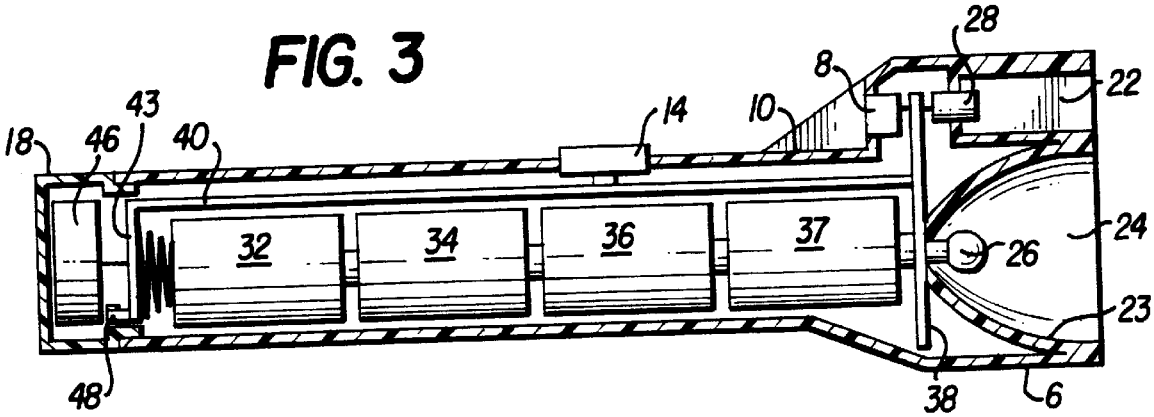

FLASHLIGHT WITH FORWARD LOOKING SENSING OF THERMAL BODIES

BACKGROUND

The present invention relates generally to a flashlight including a detector for detecting various emissions from the surroundings, and in particular, to a flashlight incorporating one or more infrared detectors for detecting thermal emissions.

Portable light emitting devices (or more commonly referred to as flashlights), serve many functions, especially in the law enforcement and emergency service fields. For instance, police officers use flashlights to perform nighttime investigations and patrols. Also, rescue workers use flashlights to perform nighttime searches for missing or injured individuals.

Yet the common flashlight has substantial limitations. In the context of searches, for example, a flashlight often can not illuminate every hidden recess of an area. For instance, in the outdoors, a missing or hiding person may be obscured by thick vegetation, and that person may be unwilling or unable to answer when he sees the approaching searchers. Additionally, the flashlight serves as a beacon to alert the missing or hiding individual of the approaching searcher. In the law enforcement context, a suspect might use this to his advantage to either flee or mount an attack on the approaching searcher.

The limitations of the conventional flashlight have been mitigated to some extent through the use of other detection devices. By way of example, police officers and emergency service personnel have been known to employ different types of night vision devices, such as "infrared goggles". In operation, these devices typically project a beam of infrared radiation onto an object to produce reflected infrared radiation. The goggles detect the reflected radiation from the object and make these reflections visible to the user.

Despite the known usefulness of the non-visible spectrum in performing investigation, there remains room for improvement in this field. Infrared night goggles, for instance, are relatively expensive due to their complexity. Also these devices may prove an impediment in emergency situations. For instance, upon discovering the whereabouts of a hiding suspect using infrared goggles, an officer might want to quickly illuminate the area with light to make an arrest. To do this, the officer must remove the cumbersome goggles, find his flashlight, aim his flashlight at the subject and turn the flashlight on. Needless to say, this series of steps takes time which jeopardizes the safety of the officer.

It is therefore an exemplary object of the present invention to supplement a conventional flashlight with one or more integral sensors which detect various characteristics of the environment, such as thermal emissions. It is a more specific object of the present invention to combine a flashlight with an infrared detector to produce a multi-function tool at relatively low cost which is easy to use.

SUMMARY

These and other exemplary objectives are achieved according to the present invention through a flashlight which includes a light source integrated with a detector for detecting various emissions from the surrounding environment. Depending on the position of a switch, the output of the detector is channeled to either a speaker or an light emitting diode (LED) array. The speaker outputs a tone having a frequency dependent on the intensity of the emissions. The LED array illuminates a series of LED elements in a manner representative of the intensity of the emissions. In one embodiment, the flashlight incorporates infrared detectors for detecting infrared thermal emissions.

BRIEF DESCRIPTION OF THE DRAWINGS

The foregoing, and other, objects, features and advantages of the present invention will be more readily understood upon reading the following detailed description in conjunction with the drawings in which:

FIG. 1 shows a perspective view of a flashlight according to one embodiment of the present invention;

FIG. 2 shows an exemplary view of a front face of the flashlight of FIG. 1;

FIG. 3 shows a cross section view of the flashlight of FIG. 1;

DETAILED DESCRIPTION

Figure 4:
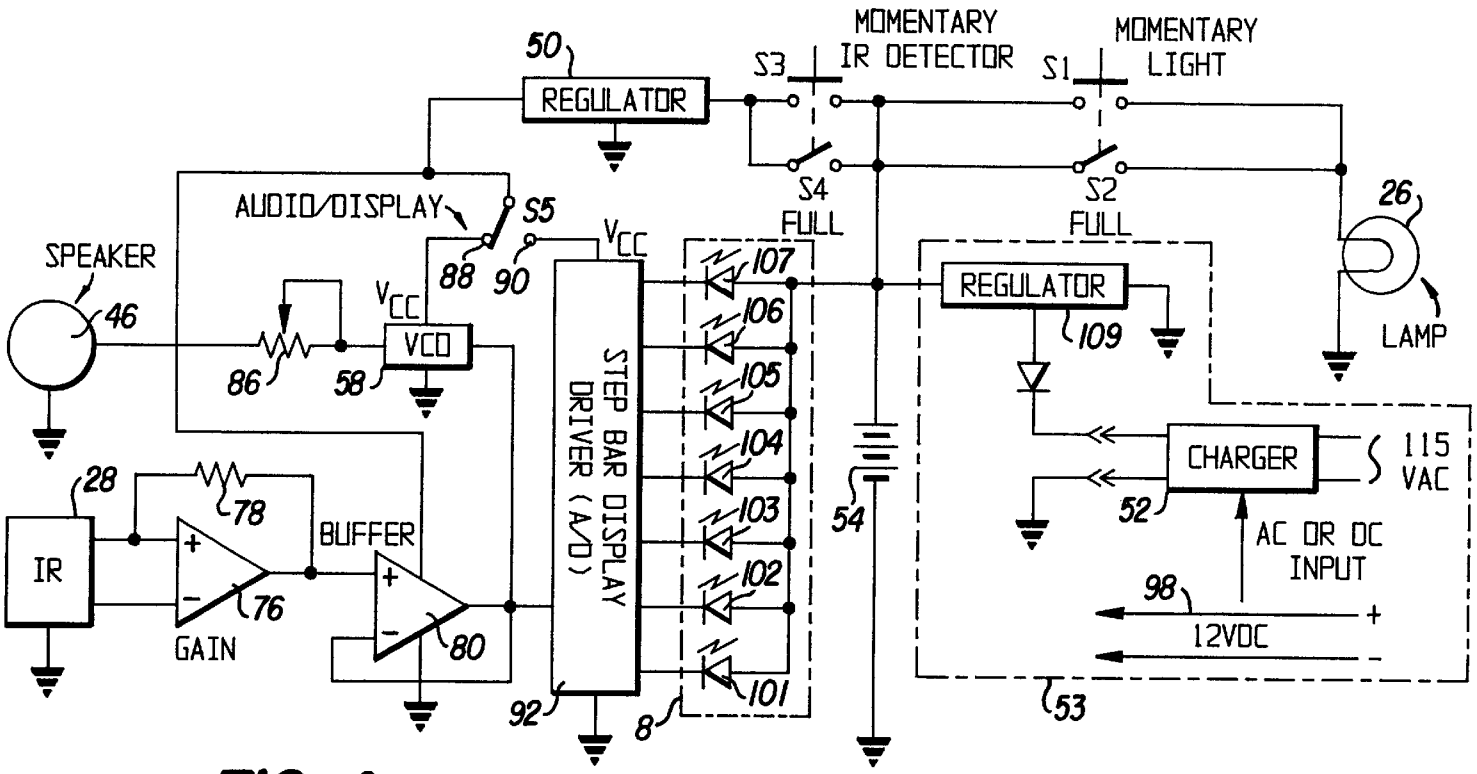
FIG. 4 shows an exemplary circuit for use in the flashlight of FIG. 1.

In the following description, for purposes of explanation and not limitation, specific details are set forth in order to provide a thorough understanding of the invention. However it will be apparent to one skilled in the art that the present invention may be practiced in other embodiments that depart from these specific details. In other instances, detailed descriptions of well-known methods, devices, and circuits are omitted so as not to obscure the description of the present invention with unnecessary detail. In the Figures, like reference numbers designate like parts.

FIGS. 1 and 2 illustrate the external appearance of an exemplary flashlight constructed according to the principles of the present invention. The flashlight 2 comprises an elongate shaft 4 having an elevated upper surface 12. A multi-position switch 14 is located in the elevated surface 12. The switch, in turn, includes a centrally disposed raised portion 16. The shaft 4, elevated surface 12 and switch 14 are designed to allow a user to grasp the flashlight 2 with one hand and operate the switch 14 with the thumb of that hand. The elevated portion 12 assists the user in locating the switch 14 in poor lighting conditions. In one embodiment, the user toggles the switch in the direction shown by arrow 17.

The shaft 4 flares out on one end to form a flashlight head 6, which has a generally rectangular cross section. However, other cross sections can be used, such circular or oval cross sections. As shown in FIG. 2, the front face of the head 6 includes a first cavity 24 containing generally cone-shaped reflective walls to direct the light generated by light bulb 26 outward in the direction which the user points the flashlight 2. The front face also includes a second cavity 22 containing one or more detectors, such as detector 28 and detector 30. As will be discussed in greater depth below, detectors 28 and 30 may be receptive to different electromagnetic frequencies, or may be receptive to different ranges of electromagnetic frequencies.

In one exemplary embodiment, infrared detectors are used which are responsive to the thermal energy in the surrounding environment, including thermal energy generated by human beings and animals. Any type of infrared detector can be used, including (but not limited to) those detectors containing thermopiles or thermocouples, or detector elements made of lead sulfide, lead selenide, indium/antimony, germanium, silicon, mercury-cadmium or tellurium. The detectors 28 and 30 are passive infrared detectors which detect the natural thermal emissions from nearby objects. However, although not shown, active infrared detectors can be used which direct a beam of infrared radiation into the nearby environment and sense the reflections generated thereby. Furthermore, although not shown, various lenses and filters can be used to enhance detection of the thermal emissions.

Returning to FIG. 1, the back portion the head 6 includes a recessed cavity 10. The cavity 10 merges into the elevated surface 12 at one end and abuts a wall 9 at generally right angles at an opposite end. An LED array 8 is attached to the wall 9. According to exemplary embodiments, the LED array 8 produces a visible signal when the detectors 28 and/or 30 sense the presence of infrared emissions in the vicinity of the flashlight. The location of the LED array 8 on the wall 9 allows the user to monitor the LED array 8 while pointing the flashlight in the direction of a suspect, but prevents the suspect in front of the flashlight from seeing the light generated by the LED array 8. This is particularly advantageous as it allows a police officer to approach a suspect with greater stealth. The LED array is also relatively inexpensive. However, those skilled in the art will recognize that other types of displays can be used, such as liquid crystal displays (LCDs) which can present alphanumeric or other indicia representative of the presence and/or strength of infrared emissions in the vicinity of the flashlight. As shown in FIG. 1, the LED or LCD display can be configured to produce a bar-type display which indicates the strength of the sensed thermal emissions.

On the opposite end of the shaft 4, the flashlight includes a rotatable cap 18. Rotation of the cap 18 in a first direction activates the LED array 8, while rotation of the cap 18 in the opposite direction activates a speaker (not shown in FIG. 1) located inside the cap 18. The speaker emits a tone when there are infrared emissions in the vicinity of the flashlight. The tone has a frequency which varies depending on the intensity of the infrared emissions. The cap 18 includes one or more openings 20 so that the speaker's output can be more readily heard outside the flashlight 2. Alternatively, although not shown, the flashlight can connect via hardwired link or radio link to headphones or an earpiece speaker. Again, this would allow a user to scan an environment for infrared emissions with greater stealth.

The flashlight operates in different modes depending on the position of switch 14 and the rotational position of the cap 18, which activates an internal switch (not shown in FIG. 1). In a first embodiment, the switch 14 can be moved in the direction of the arrow 17 to attain a plurality of positions and corresponding functional modes, such as: mode (1) in which both infrared detectors and light source are inactivated; mode (2) in which the infrared detectors are activated, but the light source is not activated; mode (3) in which just the light source is activated; and mode (4) in which both the infrared detectors and the light source are activated. In a second embodiment (not shown), these four modes can be attained by applying downward pressure on a single button in the direction of arrow 15. For example, the user can transition from mode (1) to mode (2) by pressing the button once. The user can move from mode (2) to mode (3) by pressing the button one more time, and from mode (3) to mode (4) by pressing the button once again. Pressing the button once more could return the flashlight to its off state in mode (1). This mechanism can be implemented mechanically using a multi-position button, or electrically using a state machine having a plurality of electrical states, for example. A third switching embodiment consists of a hybrid of the first and second embodiments. In this case, a multi-function switch (such as switch 14) can be displaced in the direction of the arrow 17 to define a first series of modes, and can also be displaced in the direction shown by arrow 15 to define another series of modes. Finally, according to a fourth embodiment (not shown), two separate switches can be used. A first switch can be used to turn the infrared detectors on and off, while a second switch can be used to turn the light source on and off.

In any of the first through fourth exemplary switching embodiments, the infrared and light source can be momentarily activated or fully activated. For example, in the fourth (separate detector and light switch) embodiment, the light switch can be spring loaded such that application of a first amount of force to the switch activates the light source, but upon removal of the force manually applied thereto, the switch reverts back to its off position. However, application of a second, greater, amount of force locks the switch into the ON position in which the light source remains activated even upon removal of the manual force applied thereto. The infrared switch can employ the same type of switching mechanism.

If the infrared detector is activated, rotation of cap 18 defines whether the infrared detector output is channeled to the LED array 8 or the speaker (not shown in FIG. 1). Again, those having skilled the art will recognize that other types of switches can be used to accomplish the same result.

FIG. 3 depicts a cross section of the flashlight 2. As shown there, the head 6 includes a cavity 24 with conical shaped walls 23 for directing the light provided by light bulb 26 outward in the direction which the flashlight 2 is pointed. The head 6 further includes a second cavity 22 containing one or more infrared sensors (one of which is shown as detector 28). The back end of the head includes an LED array 8.

The above-mentioned light bulb 26, detector 28 and LED array 8 are fastened to a printed circuit board 38 which provides structural support for these elements and provides electrical connection between these elements and the other components in the circuit. The circuit board 38, in turn, is generally perpendicularly affixed to a second circuit board 40. The circuit board 40 connects with the multi-position switch 14 on its top surface, and connects with an extension member 43 on one end and the circuit board 38 on the other end thereof. The extension member 43 and the circuit board 38, in turn, bracket a series of batteries 32, 34, 36 and 37. The batteries supply power to the circuit via electrical connections (not shown) to the extension member 43 and the circuit board 38. Instead of separate batteries, a built-in or removable battery pack can be used to supply power to the flashlight 2.

The shaft 4 includes the cap 18 at the opposite end as the head 6. The cap encloses a speaker 46 which is structurally and electrically connected to the extension member 43. Rotating the cap 18 contacts a switch 48. Namely, rotating the cap 18 in a first direction moves the switch 48 in a first position, and rotating the cap 18 in a second direction moves the switch 48 to a second position. The two different positions define whether the infrared detector 28 channels its output to the speaker 46 or the LED array 8.

A more detailed depiction of the electrical circuit used in the flashlight 2 is shown with reference to FIG. 4. The circuit includes four switch contacts S1 through S4 (henceforth referred to simply as "switches"), which provide the above described four functional modes. For instance, when none of switches S1 through S4 are activated, neither the light source nor the detectors are activated. When the switch S1 is activated, the light remains on in a momentary mode. When switch S2 is activated, the light remains on in a continuous ("full") mode. When switch S3 is activated, the detector remains on in a momentary mode. When S4 is activated, the detector remains on in a continuous (full) mode. When either switch S3 or S4 is activated at the same time as either switch S1 or S2, both the detectors and the light source are activated. Finally, the position of switch S5 defines whether the output of the detector is channeled through the LED display device or the audio speaker. As described above, these generically labeled switches can be mechanically implemented in a variety of ways. For instance, switch S5 can correspond to the switch 48 (shown in FIG. 3), and switches S1 through S4 can be implemented through the multi-position switch 14 discussed above, or the alternative separate switch embodiment (embodiment 4). The momentary/full switch activation feature can be implemented through spring loaded switches, as discussed above.

When the switch S3 or S4 is closed, the battery 54 supplies power to the infrared detector 28 and associated circuitry, as regulated by voltage regulator 50. Once enabled, the infrared detector 28 feeds its output to amplifier 76 (the gain of which is controlled by resistor 78) and then to buffer 80. The output of the buffer 80, in turn, is fed through either the voltage controlled oscillator 58 or the LED array driver 92, depending on the position of the switch S5 (which corresponds to switch 48 of FIG. 3 in one embodiment).

When the switch S5 is connected to node 88, the output of the infrared detector 28 is channeled to the voltage controlled oscillator 58. The voltage controlled oscillator (or VCO) 58 generates an oscillating signal having a frequency which is a function of the voltage level of the signal supplied thereto. The output of the voltage controlled oscillator 58, in turn, is fed to a resistor 86 having an adjustable resistance. The output of the resistor 86 is fed to the speaker 46 which produces a tone having a frequency proportional to the magnitude of the voltage supplied to the voltage controlled oscillator 58 and a volume dependent on the amount of resistance provided by the variable resistor 86. Instead of the speaker 46, the flashlight 2 can comprise a jack for providing connection to an earpiece speaker (not shown).

If the switch S5 is connected to the node 90 then the speaker is disabled and the output of the infrared detector is channeled through the driver 92 which drives LED array 8 comprised of LEDs 101 through 107. According to the embodiment of FIG. 4, the driver 92 comprises a circuit for converting the analog voltage value at the output of buffer 80 to digital form, and then converting this digital voltage value to a plurality of output signals to drive LEDs 101 to 107. More specifically, driver 92 drives the LEDs 101 to 107 to represent the voltage at the output of the buffer 80 as a step bar display, such that the number of LEDs illuminated is representative of the magnitude of the voltage at the output of the buffer 80, which in turn is representative of the intensity of the thermal emissions received by the passive infrared detector 28. As will be apparent to those having skill in the electrical arts, this function can also be implemented using an LCD display which presents alphanumeric information or other indicia representative of the level of the infrared field.

The flashlight circuitry can include a series of batteries (as shown in FIG. 3) or a battery pack, both of which are generally denoted as battery 54 in FIG. 4. The battery 54 can be rechargeable using an optional charger unit 53. The charger unit 53 includes a charger 52, which in turn can be connected to either a 115 V AC electrical outlet, or a 12 V DC outlet 98 (e.g. from a vehicle's battery, using the cigarette lighter as an output port). The output of the charger 52 supplies power to the battery 54 via regulator 109. Battery rechargers for flashlights are known per se in the art, and thus need not be discussed in further detail. Note, for instance, U.S. Pat. No. 5,432,689 to Sharrah et al., which is incorporated by reference herein.

Figure 5:
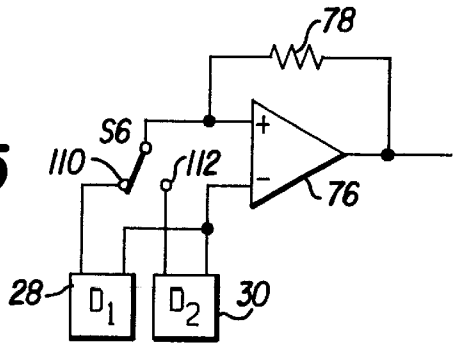
FIG. 5 shows an alternative detector configuration for use in the circuit of FIG. 4.

Instead of the single infrared detector 28, two infrared detectors 28 and 30 can be connected to the amplifier 76 as shown in FIG. 5. This embodiment includes another switch S6. When the switch S6 is connected to node 110, detector 28 is connected to the amplifier. When switch S6 is connected to node 112, detector 30 is connected to the amplifier. Detectors 28 and 30 are receptive to different frequencies, or are receptive to different ranges of frequencies. Thus, the user can switch between the two detectors to select the detector which provides the best results. For instance, different bodies emit electromagnetic energy having different frequencies, and as such, different bodies exude different thermal infrared "signatures". Thus, a plurality of detectors (such as detectors 28 and 30) can be included which are receptive to different "signatures". The switch S6 can be disposed at any location on the flashlight 2.

Although the invention has been described in the exemplary context of infrared detectors to simplify the discussion, the invention encompasses the use of other types of electromagnetic detectors, such as ultraviolet detectors, x-ray detectors, radiowave detectors or microwave detectors. While microwave, x-ray and radiowave detectors might not be employed in an ordinary search operation, when the flashlight is used by a service technician, these detectors can alert the technician of dangerous levels of microwaves, x-rays or radiowaves in their working environment.

In addition to detecting various forms of electromagnetic radiation, the invention can detect other measurable phenomena. Sensors are known in the art which detect radioactive substances, various gases and vapors, and chemical particulate. For instance, a radon or carbon monoxide sensor integrated with a flashlight would be particularly beneficial to repairmen who need both an efficient portable light source and assurances against the inhalation of dangerous gases commonly encountered in their occupations. In yet another embodiment, detectors could be incorporated which detect the presence of alcohol. In use, a policemen could scan a vehicle with his flashlight, and simultaneously receive a reading on potential recent consumption of alcohol by the driver.

The above-described exemplary embodiments are intended to be illustrative in all respects, rather than restrictive, of the present invention. Thus the present invention is capable of many variations in detailed implementation that can be derived from the description contained herein by a person skilled in the art. All such variations and modifications are considered to be within the scope and spirit of the present invention as defined by the following claims.

What is claimed is:

1. A portable device for use in scanning a region for the presence of a thermal body, said device comprising:

an elongate shaft including a first end and a second end, said shaft including a longitudinal axis defining a principal direction;

a head disposed at said first end, said head including a front face and back portion;

a light source disposed at said front face for directionally emitting a beam of light generally in said principal direction;

a detector disposed at said front face for directionally receiving electromagnetic emissions from said principal direction, and for producing output signals; and a display device disposed at said back portion for displaying information representative of said output signals produced by said detector.

2. The portable device of claim 1, further including a speaker for outputting audio information representative of said output signals produced by said detector.

3. The portable device of claim 2, further including a switch having a first and second states, wherein said display device is operational when said switch is in said first state, and said speaker is operational when said switch is in said second state.

4. The portable device of claim 3, wherein said device includes a rotatable member located at said second end of said device, wherein rotation of said rotatable member moves said switch between said first and second states.

5. The portable device of claim 1, further including a selecting mechanism for selecting first, second, third and fourth states, wherein:

in said first state, neither said detector nor said light source are operational;

in said second state, said detector is operational and said light source is not operational;

in said third state, said light source is operational but said detector is not operational; and in said fourth state, both said detector and said light source are operational.

6. The portable device of claim 5, wherein said light source and said detector can be operational in one of: a momentarily operational mode, and a continuously operational full mode.

7. The portable device of claim 1, wherein said detector comprises a plurality of detector elements.

8. The portable device of claim 1, wherein said detector comprises a detector which detects infrared emissions.

9. A device for emitting light comprising:

a housing including an electrical control mechanism;

a light source, connected to said control mechanism, for emitting light;

a detector, connected to said control mechanism for detecting emissions and producing output signals;

a first selecting mechanism, connected to said control mechanism, for activating and deactivating said light source, and for activating and deactivating said detector;

a display, connected to said control mechanism, for presenting visual information representative of said output signals;

a speaker, connected to said control mechanism, for presenting audio information representative of said output signals; and a second selecting mechanism, connected to said control mechanism, for directing said output signals to one of said display and said speaker.

10. A flashlight comprising:

a housing having a flashlight head;

said head having a front face and an oppositely disposed back portion, wherein said back portion faces a user during use of said flashlight;

said front face including a first cavity and a second cavity formed in said head;

said first cavity including a light source disposed therein for emitting light;

said second cavity including a detector disposed therein for detecting emissions and for producing output signals in response thereto; and said back portion including a display for presenting indicia representative of said output signals, said display being visible to a user during operation of said flashlight as said user scans a region for the presence of a thermal body using said flashlight.

11. A portable light emitting device for use in scanning a region for the presence of a body, said device comprising:

a housing having a front end and including a control mechanism;

a light source, connected to said control mechanism, for directionally emitting a beam of light centered about a principal direction extending outward from the front end of said device;

a detector, connected to said control mechanism for directionally detecting emissions from said same principal direction, to produce output signals;

at least one output device, connected to said control mechanism, for presenting information representative of said output signals to a user operating said device, wherein said output device indicates the presence of said body when, in the course of scanning said region, said principal direction is made coincident with a direction at which said body is oriented with respect to said device.

12. The device of claim 11, wherein said at least one output device comprises a display for displaying signals representing said output signals.

13. The device of claim 11, wherein said at least one output device comprises a speaker for generating audio signals representing said output signals.

14. The device of claim 12, wherein said at least one output device further comprises a speaker for generating audio signals representing said output signals.

15. A portable light emitting device comprising:

a housing;

a light source attached to said housing for producing light;

a detector attached to said housing for detecting emissions to produce output signals;

at least one output device attached to said housing for presenting information representative of said output signals;

wherein said at least one output device comprises a display for displaying signals representing said output signals;

wherein said at least one output device further comprises a speaker for generating audio signals representing said output signals;

wherein said device further includes a switch having a first state and a second state, wherein said display is operational in said first state and said speaker is operational in said second state.

16. A portable light emitting device comprising:

a housing;

a light source attached to said housing for producing light;

a detector attached to said housing for detecting emissions to produce output signals;

at least one output device attached to said housing for presenting information representative of said output signals;

further including a selecting mechanism for selecting first, second, third and fourth states, wherein:

in said first state, neither said detector nor said light source are operational;

in said second state, said detector is operational and said light source is not operational;

in said third state, said light source is operational but said detector is not operational; and in said fourth state, both said detector and said light source are operational.

17. The device of claim 16, wherein said light source and said detector can be operational in one of: a momentarily operational mode, and a continuously operational full mode.

18. The device of claim 11, wherein said detector comprises a plurality of detector elements.

19. The device of claim 11, wherein said detector comprises an infrared detector for detecting infrared emissions.

20. The device of claim 18, wherein said plurality of detector elements includes a first and second detector elements responsive to different electromagnetic frequencies.

21. The device of claim 20, further comprising a selecting mechanism for selecting one of a first and second states, wherein, in said first state, an output of said first detector constitutes said output signal, and in said second state, an output of said second detector constitutes said output signal.

22. The device of claim 11, wherein said at least one output device indicates the intensity of said detected emissions.

* * * * *